United States Patent [19]

Allen et al.

[11] 4,155,425

[45] May 22, 1979

[54] STABILIZED HYDRAULIC ELEVATOR

[75] Inventors: Jerry W. Allen, Greensboro; Herbert G. Cooper, Charlotte, both of N.C.

[73] Assignee: A. S. K. Elevator Service, Inc., Greensboro, N.C.

[21] Appl. No.: 825,072

[22] Filed: Aug. 16, 1977

[51] Int. Cl.[2] ..... B66B 11/04

[52] U.S. Cl. ..... 187/17

[58] Field of Search ..... 187/17, 24, 25, 32, 187/34, 35, 36

[56] References Cited

U.S. PATENT DOCUMENTS

| | | | |
|---|---|---|---|
| 186,455 | 1/1877 | Bragaldi | 187/24 |
| 438,913 | 10/1890 | Deblieux | 187/24 |
| 3,399,887 | 9/1968 | Altier | 187/17 |
| 3,650,356 | 3/1972 | Brown | 187/17 |
| 4,062,269 | 12/1977 | Chichester et al. | 187/17 |

*Primary Examiner*—Robert B. Reeves
*Assistant Examiner*—Jeffrey V. Nase
*Attorney, Agent, or Firm*—Clifton T. Hunt, Jr.

[57] ABSTRACT

A hydraulically operable elevator having a vertically reciprocable cab suspended from an overhead structure by differential hydraulic piston systems which are responsive to introduction of hydraulic fluid to decrease the overall length of the differential pistons causing the cab to ascend, and which are responsive to withdrawal of hydraulic fluid from the piston assemblies to increase the overall length of the differential pistons, allowing the cab to descend. Only one differential piston assembly is required on each side of the transverse axis of the cab to increase its stability and to provide maximum cross-sectional area for the interior of the cab.

5 Claims, 7 Drawing Figures

STABILIZED HYDRAULIC ELEVATOR

BACKGROUND OF THE INVENTION

The use of a differential piston for elevators is known in the prior art. See, for example, U.S. Pat. No. 454,872 issued June 30, 1891 to Otto Krell. A differential piston comprises a hollow piston at the upper portion of the assembly, the hollow piston being of lesser diameter than the cylinder which defines the lower portion of the assembly. The upper end of the hollow piston is attached to a superstructure above the elevator and the lower end of the hollow piston has an annular bore extending between the hollow interior of the piston and the interior of a cylinder which defines the lower portion of the differential piston. A sealing flange is fixed on the lower end of the piston beneath the annular port and frictionally engages the inner surface of the cylinder. Hydraulic fluid introduced into the top of the hollow piston flows through the annular port above the sealing flange and into the cylinder within which the sealing flange of the piston is received. The hollow piston remains stationary at all times and the cylinder reciprocates relative thereto. As hydraulic fluid is introduced into the hollow piston and enters the cylinder through the annular port, the pressure of the build-up of fluid between the inner surface of the top wall of the cylinder and the sealing flange on the piston causes the cylinder to move upwardly relative to the sealing flange thereby shortening the overall length of the assembly. The cab of an elevator is attached to the lower end of the cylinder so that the elevator rises upon the introduction of hydraulic fluid into the hollow piston to shorten the overall length of the differential piston.

The opening of a valve to remove hydraulic fluid from the cylinder causes the cylinder to move downwardly relative to the piston, thereby lengthening the differential piston and causing the elevator to descend.

One obvious advantage of such an arrangement is that it is not necessary to dig a hole in the ground to receive the cylinder of a hydraulic ram and cylinder.

U.S. Pat. No. 3,650,356 issued Mar. 21, 1972 to Richard L. Brown discloses the use of differential pistons to actuate elevators. Brown uses two laterally spaced differential pistons for raising and lowering the elevator cab, whereas Krell uses only a single differential piston for the elevator. The use of two differential pistons is preferable because it gives greater stability to the cab than does a single differential piston. However, according to Brown each of the differential pistons passes through the interior of the cab and through the same transverse plane of the cab, thereby taking away from the usable area of the cab and contributing to the instability of the cab.

Difficulty has also been experienced in the operation of the Brown elevator because of the inaccurate and unreliable registry of the cab with the floor levels.

SUMMARY OF THE INVENTION

It is therefore an object of this invention to provide a hydraulic elevator having a pair of differential pistons suspended along opposite sides of an elevator shaft, one piston on each side of the transverse axis of the cab. A cross beam is attached to the bottom of an elevator cab and extends across the transverse axis between the cylinder components of the differential pistons.

DETAILED DESCRIPTION OF THE INVENTION

Figure 1:
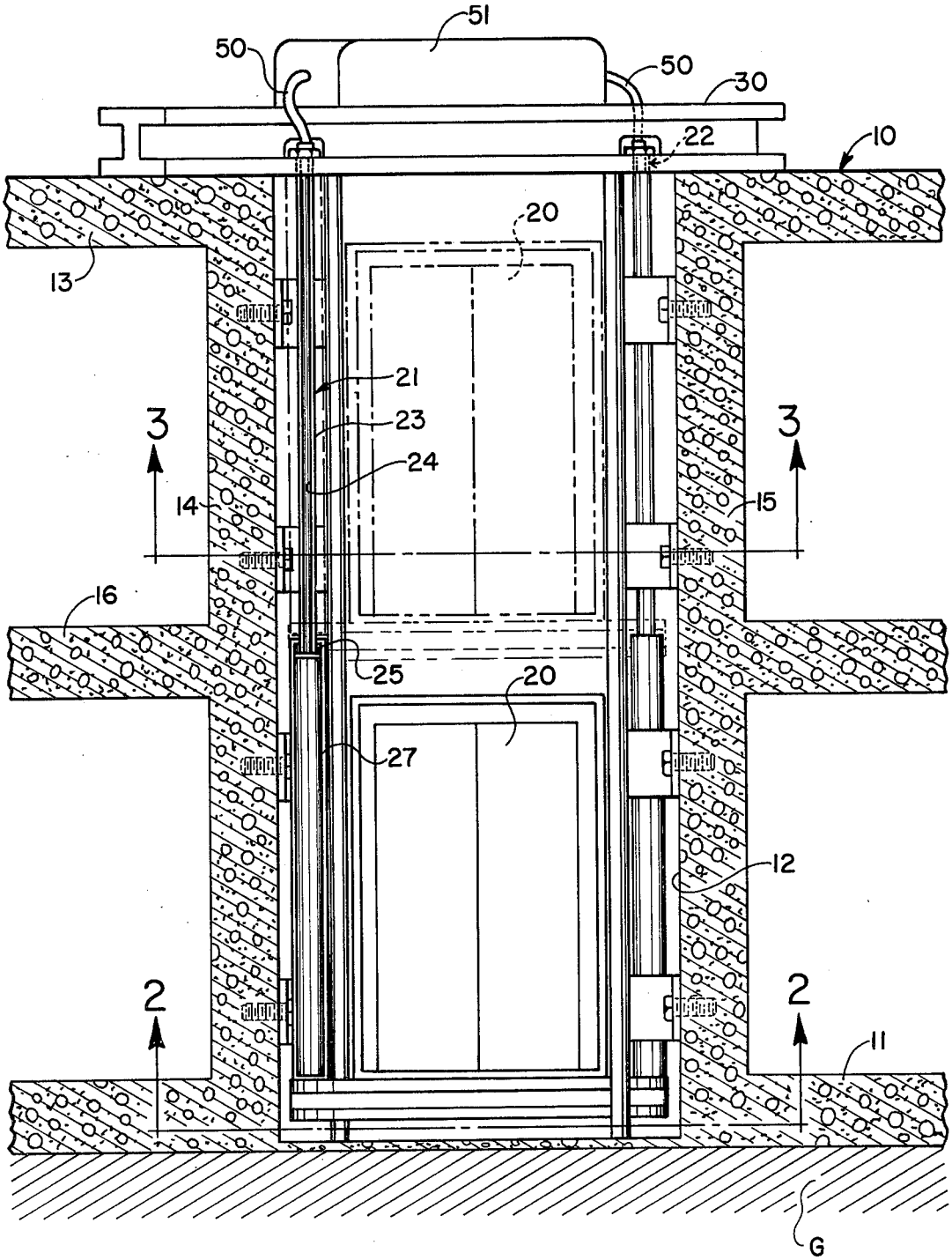
FIG. 1 is a vertical sectional view of an elevator shaft extending between two floors and showing the elevator in solid lines at the lower floor and in dotted lines at the upper floor.

Referring more specifically to the drawings, the numeral 10 broadly designates an existing two story building or structure having, for example, a concrete slab 11 poured directly on the ground G. It will be understood that the illustrated construction of the building 10 is not essential to the invention and there may be an air space between the ground and the first floor 11, if desired. The building 10 includes an elevator shaft 12 having opposed walls 14, 15 extending upwardly from the base slab 11 through the ceiling or top wall 13 of a second floor 16 of the two story structure 10.

An elevator cab 20 is positioned within the shaft 12 for reciprocable movement between the first floor 11 and the second floor 16. The cab 20 is supported within shaft 12 by differential pistons broadly indicated at 21 and 22. As used herein the term differential piston refers to that class of ram and cylinder arrangements wherein both the ram and cylinder are hollow for the reception of hydraulic fluid and wherein the introduction of hydraulic fluid into the ram causes the overall length of the ram and cylinder to shorten and consequently to cause the elevator to rise, as most clearly seen in FIGS. 4A, 4B and 4C.

Figure 4A:
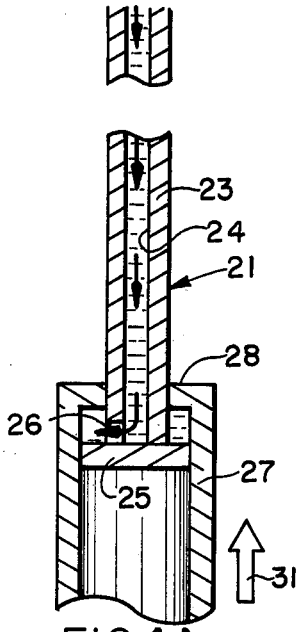
FIGS. 4A, 4B and 4C are sequential views illustrating the operation of a differential piston.
Figure 4B:
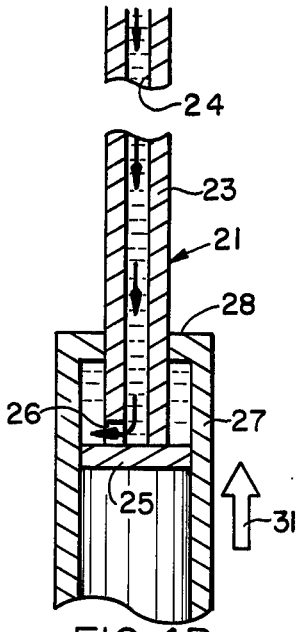
Figure 4C:
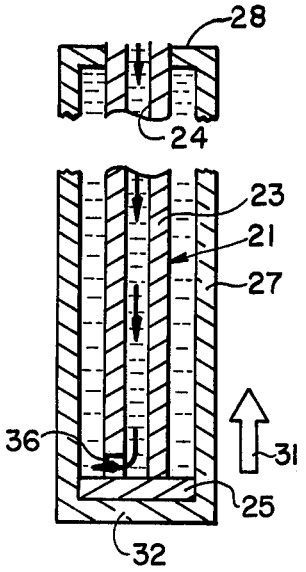

The hollow ram 23 of differential piston 21 has an axially extending passageway 24 through which hydraulic fluid flows in the direction of the directional arrows in FIGS. 4A, 4B and 4C to shorten the differential piston 21 and raise the elevator. The hollow ram 23 also includes a base plate or plunger 25 closing the passageway 24 and projecting radially beyond the axial walls of hollow ram 23. One wall of hollow ram 23 has a radially extending outlet port 26 adjacent its juncture with base plate or plunger 25. Plunger 25 is mounted within cylinder 27 in sealing engagement with the inner surfaces of the walls defining cylinder 27. Hollow ram 23 projects in sealing relation through the top wall 28 of cylinder 27.

When hydraulic fluid is introduced into hollow ram 23 in the direction of directional arrows in FIGS. 4A, 4B and 4C, the fluid flows through outlet port 26 and accumulates within that portion of the interior of cylinder 27 between plunger 25 and the inner surfaces of the top wall 28 of the cylinder 27. The upper end of hollow piston 23 is rigidly secured to a superstructure illustrated in the form of an I-beam 30 in FIG. 1. Hollow ram 23 extends downwardly from superstructure 30 within shaft 12 or to the second floor 16. Hollow ram 23 is fixed in its postion and does not move.

Referring again to FIGS. 4A, 4B and 4C, as additional hydraulic fluid is introduced into the top of hollow ram 23 and accumulates within the cavity in cylinder 27 between its top wall 28 and plunger 25, cylinder 27 is moved upwardly in the direction of the arrow 31. Continued introduction of fluid into the cavity between the top wall 28 and plunger 25 will cause cylinder 27 to rise about hollow ram 23 until plunger 25 engages bottom wall 32 of cylinder 27 as shown in FIG. 4C.

Differential piston 22 is identical to differential piston 21 and the components of differential piston 21 described in connection with FIGS. 4A, 4B and 4C apply equally to differential piston 22 and the same reference characters are used to identify the components parts of the differential pistons. Although the pistons 21 and 22 are illustrated and described as serving two adjacent floor levels 11 and 16, it is to be understood that they may be appropriately modified as explained in Brown Patent, 3,650,356 to service all floors of a multi-story structure.

The bottom walls 32 of differential pistons 21 and 22 are secured to a cross beam 33 extending beneath the floor 34 of elevator cab 20. Cross beam 33 is secured to the lower surface of elevator cab floor 34 as by brackets 35. The cross beam 33 projects angularly beyond elevator cab 20 to its juncture with bottom walls 32 of respective differential pistons 21 and 22. Thus, as hydraulic fluid is introduced into hollow ram 23 to shorten the overall length of differential pistons 21 and 22 the elevator cab 20 is raised within elevator shaft 12 from the solid line position on the first floor 11 to the dotted line position of elevator cab 20 on the second floor 16 in FIG. 1.

A plurality of chair brackets 36 extend in vertically spaced relation to each other along wall 38 of shaft 12, and each bracket 36 is bolted to its wall of shaft 12 as by bolts 40 extending through out-turned flanges 41 on the ends of the brackets 36. Each chair bracket 36 on said one wall includes a rear face 42 extending perpendicularly from one flange 41 and a front face 43 extending at an angle from the other flange 41. A guide face 44 extends between faces 42 and 43 in parallel relation to flanges 41 and spaced inwardly therefrom toward the path of cab 20 as it traverses the shaft 12.

Figure 2:
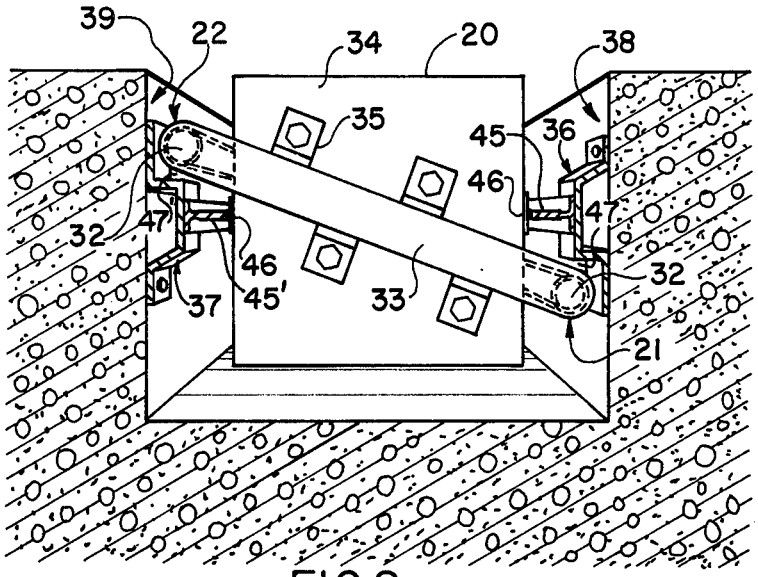
FIG. 2 is an inverted perspective plan view taken substantially along the line 2—2 in FIG. 1.
Figure 3:
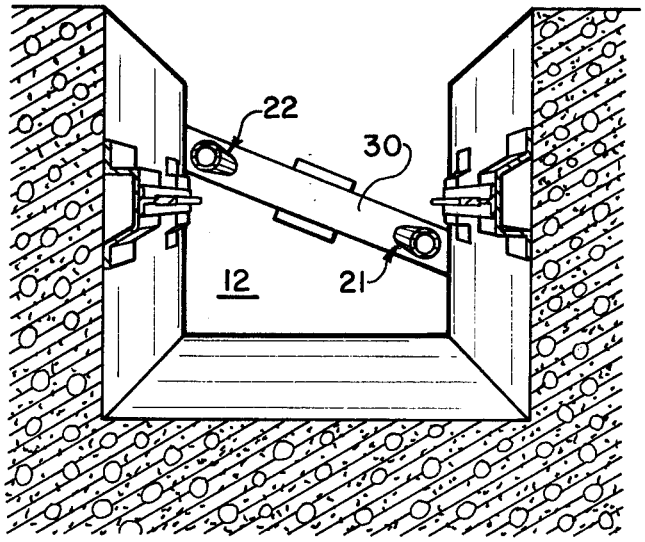
FIG. 3 is an inverted perspective plan view taken substantially along the line 3—3 in FIG. 1.

A plurality of chair brackets 37 extend in vertically spaced relation to each other along wall 39 of shaft 12. The brackets 37 are like the brackets 36 and are fastened to their wall 39 in the same manner as brackets 36 are fastened to wall 38. The parts of brackets 37 which are the same as parts of brackets 36 are identified by the same reference characters with the prime notation added. As most clearly seen in FIGS. 2 and 3 the faces 42′ of brackets 37 which extend perpendicularly from the proximal flanges 41′ is on the front side of brackets 37, whereas corresponding faces 42 on brackets 36 is on the rear side of brackets 36.

Figure 2A:
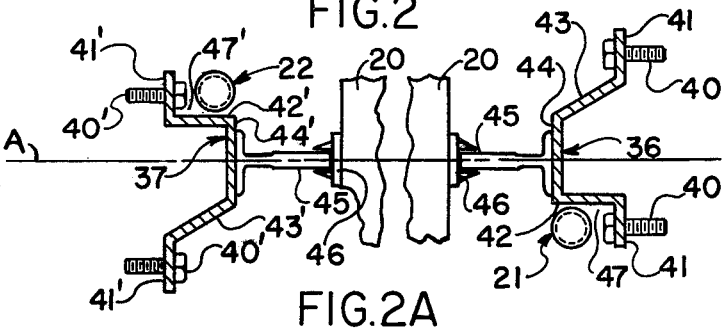
FIG. 2A is an enlarged fragmentary horizontal sectional view, with parts broken away, illustrating the relationship of the cab, the chair brackets, and the differential pistons.

The faces 42 and 42′ and their respective proximal flanges 41, 41′ define angular pockets 47, 47′ within which differential pistons 21 and 22, respectively, are positioned exteriorly of cab 20 and outwardly from respective guide faces 44, 44′. The guide faces 44, 44′ extend vertically in a common plane with the transverse axis A of cab 20 (FIG. 2A).

Tee rails 45 are fastened to the inner surfaces of guide faces 44, 44′ and project therefrom toward guide shoes 46 extending vertically along the transverse axis A of cab 20. The Tee rails 45 engage the guide shoes 46 and stabilize the cab 20 during its vertical movement.

The differential pistons 21 and 22 extend vertically within their pockets 47, 47′ on opposite sides of the transverse axis A of cab 20, thereby stabilizing cab 20 and permitting cab 20 to occupy all of the space between opposed Tee rails 45. This is advantageous in that the stabilized cab is enabled to have the maximum dimensions consistent with the size of the elevator shaft 12. The cross beam 33 extends at an angle across the transverse axis A and across the lower surface of floor 34 between the off-set differential pistons 21 and 22, and the I-beam 30 extends at a corresponding angle above the shaft 12 to engage pistons 21 and 22 extending upwardly from their junctures with cross beam 33. Hollow rams 23 are rigidly connected with opposite end portions of superstructure or I-beam 30. The open upper ends of hollow rams 23 on differential pistons 21 and 22 communicate with hydraulic lines 50 extending from manifold 51 atop superstructure 30. Hydraulic fluid is pumped through hydraulic lines 50 into differential pistons 21 and 22 from a suitably located reservoir, not shown.

There is thus provided an improved support system for stabilizing the cab during transit.

In the drawings and specification there has been set forth a preferred embodiment of the invention and although specific terms are employed they are used in a descriptive and generic sense only and not for pusposes of limitation, the scope of the invention being defined in the claims.

We claim:

1. A hydraulic elevator having a cab vertically reciprocable within a shaft between chair brackets spaced vertically along opposed walls of the shaft and a superstructure above the shaft, said cab having a first transverse axis extending in one direction and a second transverse axis extending in perpendicular relation to said first transverse axis and said elevator including only two differential pistons extending in spaced vertical planes between said axes and between the superstructure and the cab, means connecting corresponding ends of the differential pistons to the superstructure and the cab, and means for flowing hydraulic fluid into and out of the differential pistons to move the elevator vertically within the shaft.

2. In a hydraulic elevator having a superstructure, a cab, means on opposite sides of the cab for guiding the cab during vertical movement, and said cab having a transverse axis extending between its said opposite sides, the combination of means supporting the cab from the superstructure for vertically reciprocable movement within the shaft, said means comprising only two hydraulically operable piston and cylinder assemblies each including a fixed piston rigidly secured to the superstructure and a vertically reciprocable cylinder attached at its lower end to the cab, and the piston and cylinder assemblies extending along opposite sides of the transverse axis of the cab.

3. A hydraulic elevator having a cab vertically reciprocable within a shaft between chair brackets spaced vertically along opposed walls of the shaft and a superstructure above the shaft, said cab having a transverse axis extending between the said opposed walls and said elevator including only two differential pistons extending in spaced vertical planes on opposite sides of said transverse axis between the superstructure and the cab, means connecting corresponding ends of the differential pistons to the superstructure and the cab, and means for flowing hydraulic fluid into and out of the differential pistons to move the elevator vertically within the shaft.

4. A hydraulic elevator according to claim 3 wherein each of said chair brackets includes a guide face and Tee-rails fastened to the inner surfaces of the guide faces and projecting inwardly therefrom, guide shoes projecting outwardly from opposed walls of the cab, and said Tee-rails engaging the guide shoes to stabilize the cab during its vertical movement.

5. A hydraulic elevator according to claim 4 wherein the guide shoes project outwardly along the transverse axis of said cab.

* * * * *